US010546711B2

(12) United States Patent
Trail et al.

(10) Patent No.: US 10,546,711 B2
(45) Date of Patent: Jan. 28, 2020

(54) ELECTROMAGNETIC INTERFERENCE CONTAINMENT FOR ACCELERATOR SYSTEMS

(71) Applicant: Varian Medical Systems, Inc., Palo Alto, CA (US)

(72) Inventors: Mark E. Trail, Menlo Park, CA (US); Rudolf H. Potter, Los Altos, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 0 days.

(21) Appl. No.: 16/519,840

(22) Filed: Jul. 23, 2019

(65) Prior Publication Data

US 2019/0348248 A1 Nov. 14, 2019

Related U.S. Application Data

(62) Division of application No. 15/245,551, filed on Aug. 24, 2016, now Pat. No. 10,366,859.

(51) Int. Cl.

| | |
|---|---|
| ***H01J 29/00*** | (2006.01) |
| ***H01J 29/96*** | (2006.01) |
| ***H01J 29/48*** | (2006.01) |
| ***H01J 23/15*** | (2006.01) |

(52) U.S. Cl.

CPC ..... *H01J 29/003* (2013.01); *H01J 23/15* (2013.01); *H01J 29/485* (2013.01); *H01J 29/96* (2013.01)

(58) Field of Classification Search

None

See application file for complete search history.

(56) References Cited

U.S. PATENT DOCUMENTS 2,619,776 A * 12/1952 Potters ..... C03B 19/1025 65/21.3
2,789,154 A * 4/1957 Peterson ..... H01B 5/004 174/73.1
3,179,740 A * 4/1965 Schlein ..... H01B 17/44 174/127
3,377,420 A * 4/1968 Brown ..... H02G 15/064 174/73.1
3,412,200 A * 11/1968 Virsberg ..... H01B 9/027 174/102 SC (Continued)

FOREIGN PATENT DOCUMENTS

JP 2002208356 A 7/2002

OTHER PUBLICATIONS

EIC Search report—004 from STIC.*

(Continued)

*Primary Examiner* — Dion Ferguson
*Assistant Examiner* — Srinivas Sathiraju
(74) *Attorney, Agent, or Firm* — Vista IP Law Group, LLP

(57) ABSTRACT

An apparatus for coupling to an input connection of an electron gun, the input connection having a heater terminal and a cathode terminal, includes: a connector having a first end and a second end; wherein the first end of the connector is configured to attach to a cable; wherein the second end of the connector is configured to connect to the input connection of the electron gun; and wherein the connector comprises an opening configured to receive the heater terminal of the input connection of the electron gun.

17 Claims, 8 Drawing Sheets

(56) References Cited

U.S. PATENT DOCUMENTS 3,474,393 A * 10/1969 Woods ..... H01R 13/53 439/89
3,573,210 A * 3/1971 Furusawa et al. ..... H01B 3/28 174/110 AR
3,773,967 A * 11/1973 Sturm ..... H02G 7/14 174/42
3,828,116 A * 8/1974 Lonow ..... G01R 31/021 174/73.1
4,473,765 A * 9/1984 Butman, Jr. ..... H02K 3/40 174/127
4,988,919 A * 1/1991 Tanabe ..... H05H 7/18 313/360.1
5,632,955 A 5/1997 Gabbai
5,834,898 A 11/1998 True
6,039,834 A * 3/2000 Tanaka ..... C23C 16/511 118/723 ME
6,127,779 A * 10/2000 True ..... H01J 3/027 313/296
6,347,636 B1 * 2/2002 Xia ..... B08B 7/0035 134/1.1
6,356,025 B1 * 3/2002 Freeman ..... H01J 37/32082 315/111.51
6,683,245 B1 * 1/2004 Ogawa ..... H05K 9/0037 174/382
6,831,232 B2 * 12/2004 Henricks ..... H01B 17/16 174/142
6,864,633 B2 * 3/2005 Trail ..... H05H 9/04 315/5.41
7,339,320 B1 * 3/2008 Meddaugh ..... H05H 9/048 315/5.41
7,400,093 B2 * 7/2008 Salop ..... H05H 9/04 315/5.41
8,317,681 B1 * 11/2012 Gazdzinski ..... A61B 1/00016 600/118
8,636,648 B2 * 1/2014 Gazdzinski ..... A61B 1/00016 600/109
8,764,741 B2 * 7/2014 Dabney ..... A61B 18/1206 606/39
9,081,066 B2 * 7/2015 Hetherington ... G01R 33/34007
9,588,235 B2 * 3/2017 Weisfield ..... G01T 1/2018
9,705,610 B2 * 7/2017 Barzegar ..... H04B 3/546
9,717,137 B2 * 7/2017 Hansen ..... H05G 1/025
2004/0195971 A1 * 10/2004 Trail ..... H01J 35/00 315/5.41
2005/0134203 A1 * 6/2005 Salop ..... H01J 35/00 315/500
2009/0243756 A1 * 10/2009 Stevenson ..... A61N 1/3754 333/172
2012/0112748 A1 * 5/2012 Hetherington ... G01R 33/34007 324/318
2012/0223706 A1 * 9/2012 Hetherington ... G01R 33/34007 324/307
2013/0235550 A1 * 9/2013 Stevenson ..... A61N 1/3754 361/818
2013/0271144 A1 * 10/2013 Avdievich ..... G01R 33/3642 324/322
2014/0163664 A1 * 6/2014 Goldsmith ..... A61B 17/00491 623/1.11
2015/0028869 A1 * 1/2015 Kozlov ..... G01R 33/5612 324/307
2015/0150433 A1 * 6/2015 Gazdzinski ..... A61B 1/00016 600/109
2015/0208907 A1 * 7/2015 Gazdzinski ..... A61B 1/00016 600/476
2016/0030761 A1 * 2/2016 Butters ..... A61N 2/004 600/14

OTHER PUBLICATIONS

Search and Examination Report dated Feb. 26, 2018 for UK Patent Application No. GB1712705.1, 10 pages.
Notice of Allowance dated Nov. 9, 2018 for U.S. Appl. No. 15/245,551.
Non-Final Office Action dated Apr. 5, 2018 for U.S. Appl. No. 15/245,551.
Notice of Allowance dated Mar. 28, 2019 for U.S. Appl. No. 15/245,551.
First Office Action dated Mar. 7, 2019 for Chinese Patent Application No. 201710667125.3.

* cited by examiner

ELECTROMAGNETIC INTERFERENCE CONTAINMENT FOR ACCELERATOR SYSTEMS

RELATED APPLICATION DATA

This application is a divisional application of U.S. patent application Ser. No. 15/245,551 filed on Aug. 24, 2016, pending. The entire disclosure of the above application is expressly incorporated by reference herein.

FIELD

The field of the application relates to accelerator systems, such as those used in medical systems, and more particularly, to systems and methods for electromagnetic interference containment for accelerator systems.

BACKGROUND

Radiation therapy involves medical procedures that selectively deliver high doses of radiation to certain areas inside a human body. A radiation machine for providing radiation therapy includes an electron source that provides electrons, and an accelerator that accelerates the electrons to form an electron beam. The electron beam is delivered downstream where it strikes a target to generate radiation. The radiation is then collimated to provide a radiation beam having a certain desired characteristic for treatment purpose.

Radiation may also be used to provide imaging of a patient so that internal tissue may be visualized.

Medical systems that provide radiation, either for treatment or for diagnostic imaging, have a radiation system configured to provide and accelerate electrons for generating radiation. The radiation system may have an electron gun that generates the electrons, an accelerator that accelerates the electrons, and a microwave device (e.g., a Magnetron) configured to provide microwave power for the accelerator. In some cases, the radiation system may also include a modulator for providing input for the magnetron and the electron gun. Use of the radiation system may result in radiated electromagnetic radiation due to high voltage pulses resulted from the operation of the modulator with the magnetron and the electron gun.

SUMMARY

An apparatus for attachment to a component of a microwave device, includes: a cage; a shield within the cage, wherein the shield is in a form of a container, and at least a majority of the shield is spaced away from an interior wall of the cage; and a connector at the cage, wherein the connector is configured to connect to a cable connection, and wherein the connector is electrically connected to two terminals within the shield.

Optionally, the shield comprises a first opening for receiving wires from the connector.

Optionally, the shield further comprises a second opening and a third opening for receiving the two terminals respectively.

Optionally, one of the two terminals comprises a cathode terminal.

Optionally, another one of the two terminals comprises a heater terminal.

Optionally, the heater terminal is electrically isolated from the shield.

Optionally, the cathode terminal is electrically connected to the shield.

Optionally, the connector comprises a ground connection to the cage.

Optionally, a voltage between the two terminals has a first voltage value, and a voltage between the shield and the cage has a second voltage value that is higher than the first voltage.

Optionally, the second voltage (e.g., an absolute value of the second voltage) is at least 1000 times larger than the first voltage (e.g, an absolute value of the first voltage).

Optionally, the apparatus further includes a RF absorber contained inside the cage.

Optionally, the shield is coupled to the RF absorber. For example, the shield may be mechanically coupled to the RF absorber.

Optionally, the apparatus further includes a protection circuit contained inside the shield.

Optionally, the protection circuit comprises a capacitor and a voltage limiting device, the capacitor having a first lead and a second lead, the voltage limiting device having a third lead and a fourth lead, wherein the first lead of the capacitor and the third lead of the voltage limiting device are connected to one of the two terminals in the shield (e.g., surrounded by the shield), and wherein the second lead of the capacitor and the fourth lead of the voltage limiting device are connected to another one of the two terminals in the shield.

Optionally, the protection circuit is configured to prevent current from flowing through the protection circuit until a pre-determined voltage is reached.

Optionally, the protection circuit comprises a bipolar or unipolar transient-voltage suppression (TSV) diode.

Optionally, a portion of the shield comprises a dome shape.

Optionally, the microwave device comprises a Magnetron, and wherein the cage is configured to attach to the component of the Magnetron.

An apparatus for coupling to an input connection of an electron gun, the input connection having a heater terminal and a cathode terminal, the apparatus comprising: a connector having a first end and a second end; wherein the first end of the connector is configured to attach to a cable; wherein the second end of the connector is configured to connect to the input connection of the electron gun; and wherein the connector comprises an opening configured to receive the heater terminal of the input connection of the electron gun.

Optionally, the connector has a bullet shape. The connector may have other shapes in other embodiments, which minimizes or at least reduces electric field inside a high voltage insulation.

Optionally, the first end of the connector has a cross sectional dimension that varies non-linearly.

Optionally, the heater terminal comprises a pin.

Optionally, the cathode terminal of the electron gun comprises a cylindrical connector, and wherein the second end of the connector has an outer cross sectional dimension sized to fit within the cylindrical connector of the electron gun.

Optionally, the second end of the connector comprises a coil (e.g., a canted coil), and wherein the coil is configured to circumferentially engage the cylindrical connector of the electron gun.

Optionally, the connector comprises a first section with the opening, wherein the first section is configured for connection with a first wire from the cable.

Optionally, the connector comprises a second section configured for connection with a second wire from the cable, wherein the second section is electrically coupled to a circular structure circumferentially disposed around the first section.

Optionally, the connector comprises a first section with first plurality of connection terminals for connection with respective cathode wires from the cable.

Optionally, the connector comprises a second section with a second plurality of connection terminals for connection with respective heater wires from the cable.

Optionally, the first section comprises the opening.

Optionally, the second section is electrically coupled to a circular structure circumferentially disposed around the first section.

Optionally, the apparatus further includes a tube disposed around the component of the electron gun.

Optionally, the tube may slide (i.e., is slidable) relative to the component of the electron gun.

Optionally, the tube has a wall with a first opening and a second opening.

Optionally, the first opening and the second opening are at respective opposite sides of the tube.

Optionally, the tube is configured to contain potting material.

Optionally, the apparatus further includes a seal structure disposed at one end of the tube, the seal structure having an opening for receiving the cable, wherein the seal structure has a curvilinear inner surface, and wherein a distance between the curvilinear inner surface and the cable varies non-linearly as a function of a position along a longitudinal axis of the cable.

An apparatus for attachment to a component of a microwave device includes: a cage configured to provide EMI shielding; and a shield within the cage, wherein the shield is configured to provide corona shielding; wherein the shield comprises a cavity for accommodating two terminals.

Other and further aspects and features will be evident from reading the following detailed description.

DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims.

DETAILED DESCRIPTION

Figure 1A:
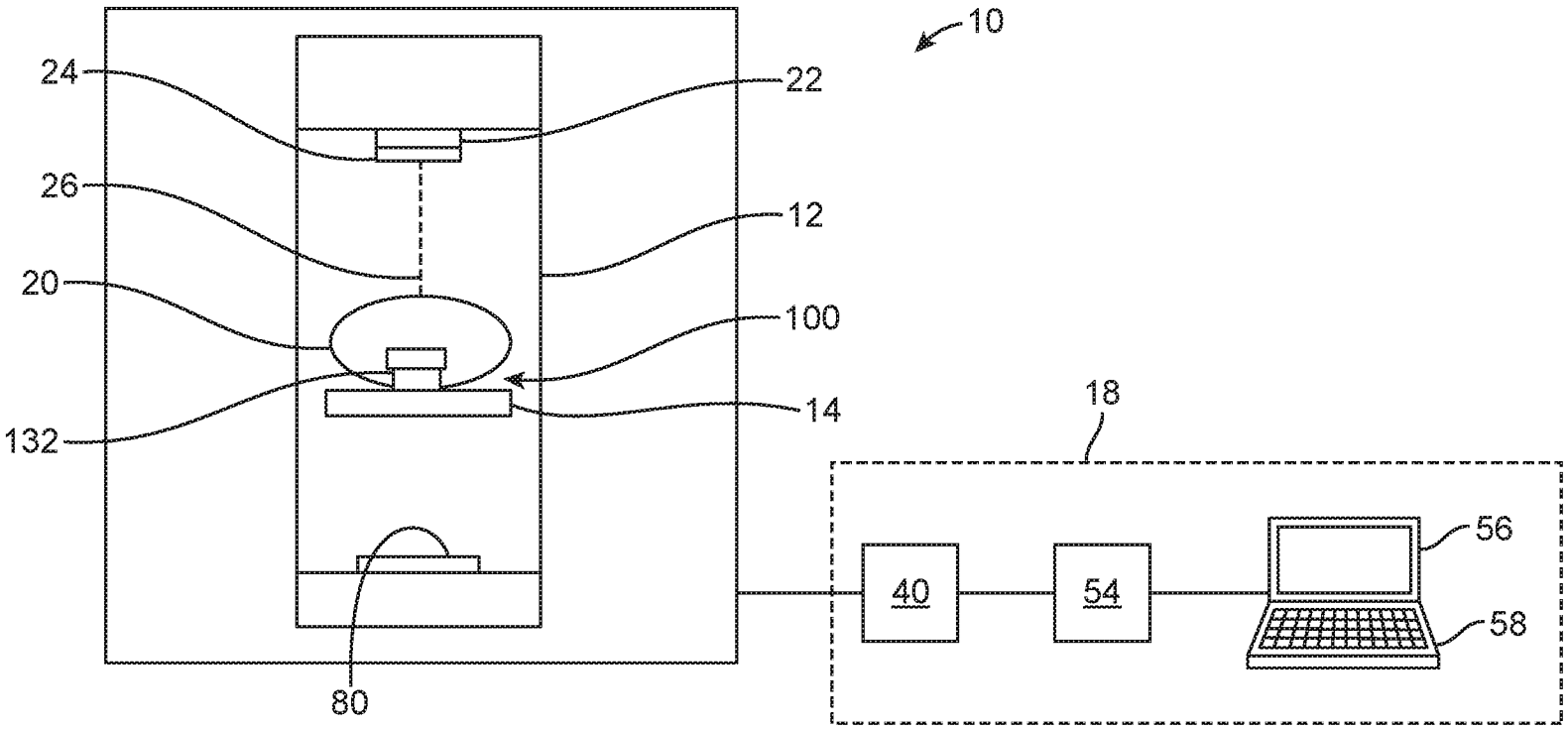
FIG. 1A illustrates a radiation system in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1A illustrates a radiation treatment system 10. The system 10 includes an arm gantry 12, a patient support 14 for supporting a patient 20, and a control system 18 for controlling an operation of the gantry 12 and delivery of radiation. The system 10 also includes a radiation source 22 that projects a beam 26 of radiation towards the patient 20 while the patient 20 is supported on support 14, and a collimator system 24 for changing a cross sectional shape of the radiation beam 26. The radiation source 22 may be configured to generate a cone beam, a fan beam, or other types of radiation beams in different embodiments. Also, in other embodiments, the source 22 may be configured to generate a proton beam, electron beam, or neutron beam, as a form of radiation for treatment purpose. Also, in other embodiments, the system 10 may have other form and/or configuration. For example, in other embodiments, instead of an arm gantry 12, the system 10 may have a ring gantry 12.

In the illustrated embodiments, the radiation source 22 is a treatment radiation source for providing treatment energy. In other embodiments, in addition to being a treatment radiation source, the radiation source 22 can also be a diagnostic radiation source for providing diagnostic energy for imaging purpose. In such cases, the system 10 will include an imager, such as the imager 80, located at an operative position relative to the source 22 (e.g., under the support 14). In further embodiments, the radiation source 22 may be a treatment radiation source for providing treatment energy, wherein the treatment energy may be used to obtain images. In such cases, in order to obtain imaging using treatment energies, the imager 80 is configured to generate images in response to radiation having treatment energies (e.g., MV imager). In some embodiments, the treatment energy is generally those energies of 160 kilo-electron-volts (keV) or greater, and more typically 1 mega-electron-volts (MeV) or greater, and diagnostic energy is generally those energies below the high energy range, and more typically below 160 keV. In other embodiments, the treatment energy and the diagnostic energy can have other energy levels, and refer to energies that are used for treatment and diagnostic purposes, respectively. In some embodiments, the radiation source 22 is able to generate X-ray radiation at a plurality of photon energy levels within a range anywhere between approximately 10 keV and approximately 20 MeV. In further embodiments, the radiation source 22 can be a diagnostic radiation source. In such cases, the system 10 may be a diagnostic system with one or more moving parts. In the illustrated embodiments, the radiation source 22 is carried by the arm gantry 12. Alternatively, the radiation source 22 may be located within a bore (e.g., coupled to a ring gantry).

In the illustrated embodiments, the control system 18 includes a processing unit 54, such as a processor, coupled to a control 40. The control system 18 may also include a monitor 56 for displaying data and an input device 58, such as a keyboard or a mouse, for inputting data. The operation of the radiation source 22 and the gantry 12 are controlled by the control 40, which provides power and timing signals to the radiation source 22, and controls a rotational speed and position of the gantry 12, based on signals received from the processing unit 54. Although the control 40 is shown as a separate component from the gantry 12 and the processing unit 54, in alternative embodiments, the control 40 can be a part of the gantry 12 or the processing unit 54.

In some embodiments, the system 10 may be a treatment system configured to deliver treatment radiation beam towards the patient 20 at different gantry angles. During a treatment procedure, the source 22 rotates around the patient 20 and delivers treatment radiation beam from different gantry angles towards the patient 20. While the source 22 is at different gantry angles, the collimator 24 is operated to change the shape of the beam to correspond with a shape of the target tissue structure. For example, the collimator 24 may be operated so that the shape of the beam is similar to a cross sectional shape of the target tissue structure. In another example, the collimator 24 may be operated so that different portions of the target tissue structure receive different amount of radiation (as in an IMRT procedure).

Figure 1B:
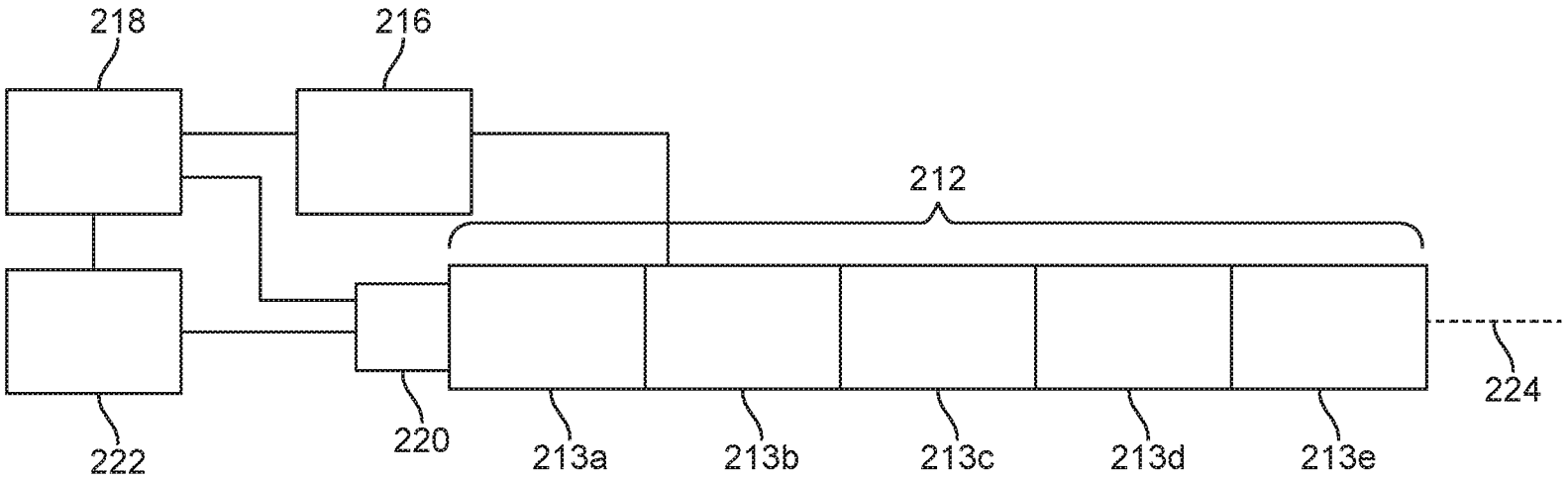
FIG. 1B illustrates some components of the radiation system of FIG. 1A.

FIG. 1B is a block diagram illustrating some components of the radiation system 10. The components of the radiation system 10 include an electron accelerator 212 that is coupled to a Magnetron 216 and a modulator 218 in accordance with some embodiments. The accelerator 212 includes a plurality of axially aligned cavities 213 (electromagnetically coupled resonant cavities). In the figure, five radiofrequency cavities 213*a*-213*e* are shown. However, in other embodiments, the accelerator 212 can include other number of cavities 213. The radiation system 10 also includes a particle source 220 (e.g., electron gun) for injecting particles such as electrons into the accelerator 212. During use, the accelerator 212 is excited by a power, e.g., microwave power, delivered by the Magnetron 216 at a frequency, for example, between 1000 MHz and 20 GHz, and more typically, between 2800 and 3000 MHz. In other embodiments, the Magnetron 216 can have other configurations and/or may be configured to provide power at other frequencies. The power delivered by the Magnetron 216 may be in a form of electromagnetic waves. The electrons generated by the particle source 220 are accelerated through the accelerator 212 by oscillations of the electromagnetic fields within the cavities 213 of the accelerator 212, thereby resulting in a high energy electron beam 224. The electron beam 224 strikes a target downstream to produce radiation with certain desired characteristics. The radiation may exit from the radiation source 22 of FIG. 1A, and may then be collimated by the collimator 24 that shapes the radiation into a radiation beam with certain desired shape. As shown in FIG. 1B, the radiation system 10 may further include a computer or processor 222, which controls an operation of the particle source 220 and/or the modulator 218. In other embodiments, instead of the Magnetron, item 216 may be other types of power source, such as a klystron, or any microwave source (e.g., pulsed high-power microwave source).

Figure 2:
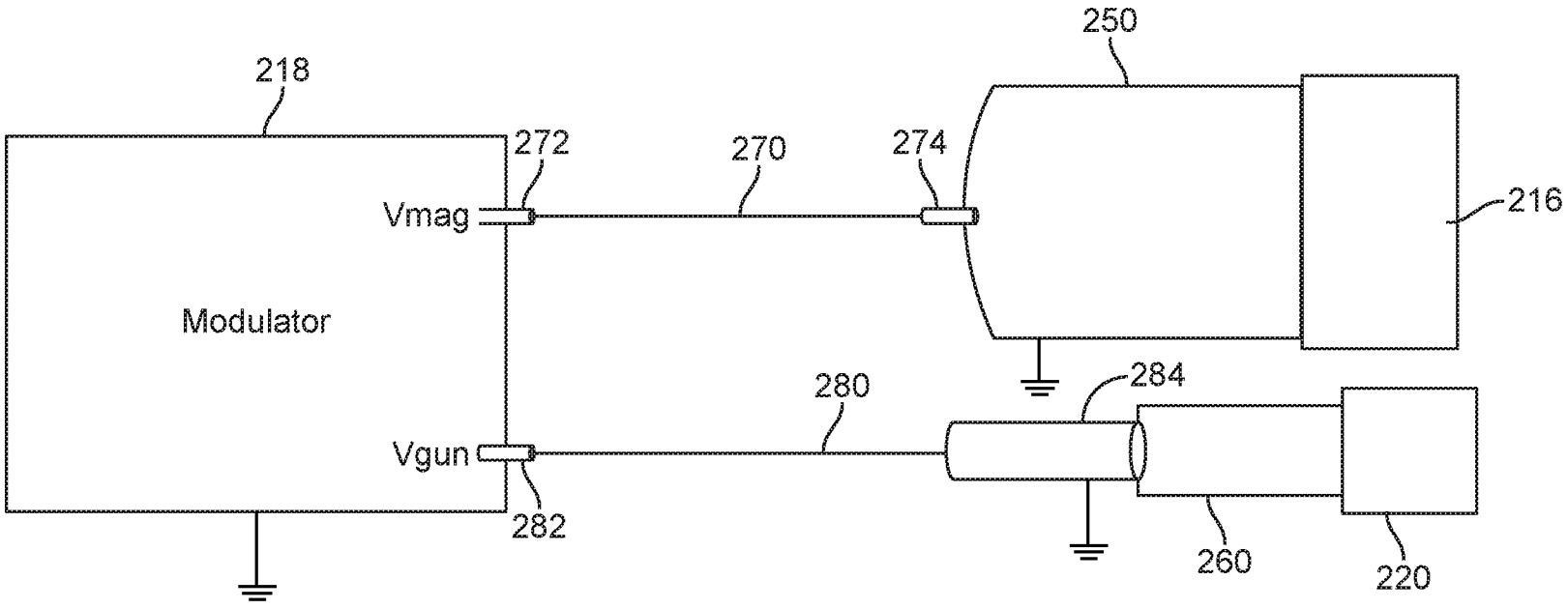
FIG. 2 illustrates a modulator connected to a first apparatus for providing electromagnetic interference containment at a Magnetron, and a second apparatus for providing electromagnetic interference containment at an electron gun.

FIG. 2 illustrates first apparatus 250 and second apparatus 260 for providing electromagnetic interference containments for the system of FIG. 1B. In particular, the modulator 218 is connected to a first apparatus 250 for providing electromagnetic interference (EMI) containment at the interface between the Magnetron 216 and cable 270, and is also connected to a second apparatus 260 for providing electromagnetic interference containment at the interface between the electron gun 220 and cable 280. In some embodiments, the modulator 218 is configured to provide a −45 kV, 4.5 uS, 105A pulse to the Magnetron, and also to provide a −27 kV, 4.5 uS, 0.5A pulse to the electron gun 220 via two respective high voltage socket terminals at the modulator 218. These pulses are provided to the Magnetron 216 and the electron gun 220 via respective shield high voltage cables (the first cable 270 and second cable 280), which plug into the sockets of the modulator 218 with mating high voltage connectors. In other embodiments, the pulses provided to the Magnetron 216 and to the electron gun 220 may have other characteristics (e.g., energy level, amplitude level, pulse width, etc.) that are different from those described.

During use, the first cable 270 is configured to receive a high voltage from the modulator 218, and transmit the high voltage to the Magnetron 216. Similarly, the second cable 280 is configured to receive a high voltage from the modulator 218, and transmit the high voltage to the electron gun 220. To contain electromagnetic interference from the transmission of the high voltage by the first cable 270, the first apparatus 250 is provided at the interface between the first cable 270 and the Magnetron 216. Similarly, to contain electromagnetic interference from the transmission of the high voltage by the second cable 280, the second apparatus 260 for containing electromagnetic interference is provided at the interface between the second cable 280 and the electron gun 220.

In some embodiments, the first apparatus 250 includes a cage for EMI containment, and the second apparatus 260 includes an electron gun shield also for EMI containment. The first apparatus 250 will be described with reference to FIGS. 3-5. The second apparatus 260 will be described with reference to FIGS. 6-8.

As shown in the figure, the modulator 218 is connected to the first apparatus 250 via the first cable 270 having a first connector 272 and a second connector 274. The first connector 272 of the first cable 270 is configured to couple to a corresponding connector at the modulator 218. The second connector 274 of the first cable 270 is configured to connect to the first apparatus 250. In the illustrated embodiments, the first connector 272 of the first cable 270 is detachably coupled to the connector at the modulator 218, and the second connector 274 of the first cable 270 is detachably coupled to the first apparatus 250. In other embodiments, the first connector 272 may be fixedly or permanently coupled to the connector at the modulator 218, and/or the second connector 274 may be fixedly or permanently coupled to the first apparatus 250.

The modulator 218 is also connected to the second apparatus 260 via the second cable 280 having a first connector 282 and a second connector 284. The connector 282 of the second cable 280 is configured to couple to a corresponding connector at the modulator 218. The second connector 284 of the second cable 280 is configured to connect to the second apparatus 260.

The cables 270, 280 are flexible. Each of the cables 270, 280 is configured to hold off 75 kV (or other values) DC, and are shielded by an external braided shield. The braided shield is circumferentially (360°) coupled to the ground of the modulator 218 via the connector, thereby containing any radiated emissions. The chassis of the modulator 218, the cage of the first apparatus 250, and the electron gun shield at the second apparatus 260 are grounded, sharing a common ground.

Figure 3:
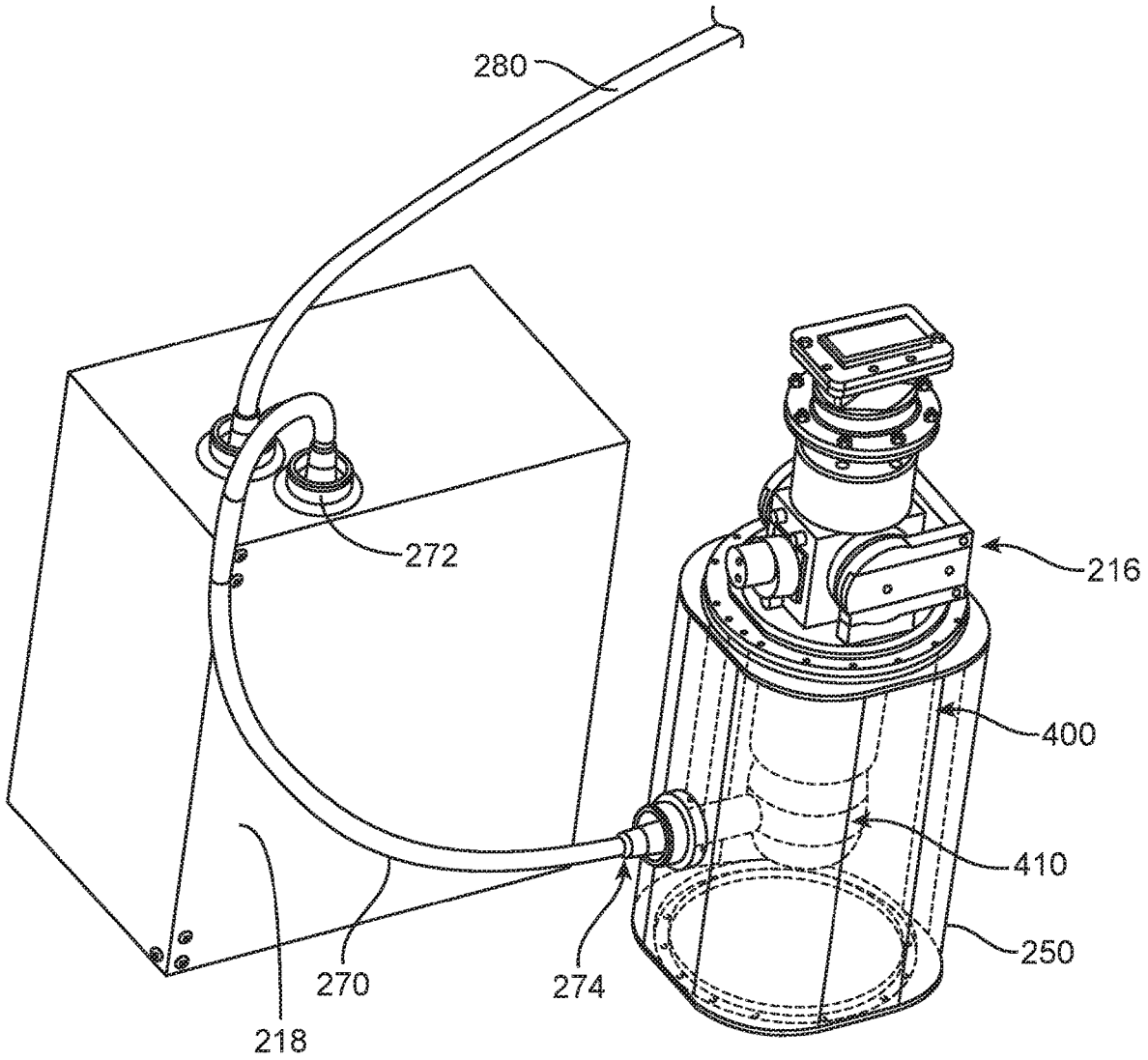
FIG. 3 illustrates an implementation of the first apparatus of FIG. 2.
Figure 4A:
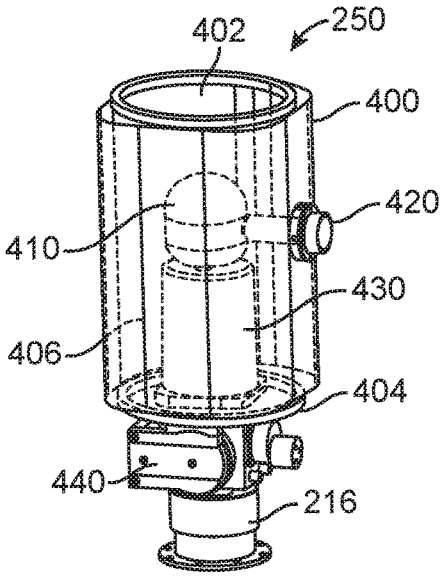
FIG. 4A illustrates the first apparatus of FIG. 3.
Figure 4B:
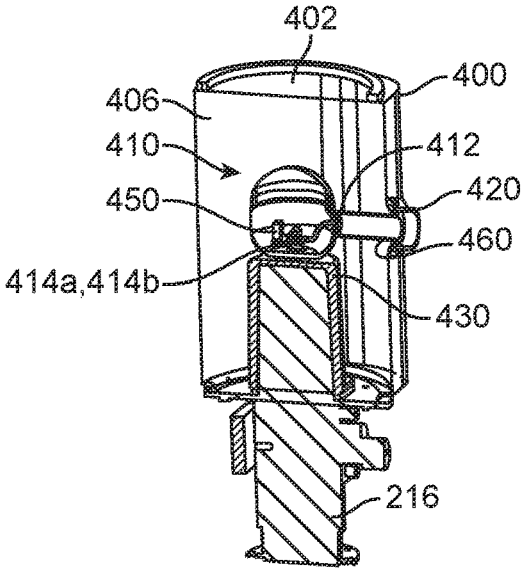
FIG. 4B illustrates some internal details of the first apparatus of FIG. 4A.

FIGS. 3, 4A, and 4B illustrate an implementation of the first apparatus 250 of FIG. 2. As shown in FIG. 3, the apparatus 250 is for providing electromagnetic interference containment at the interface between the first cable 270 and the Magnetron 216. The apparatus 250 is configured to contain the electromagnetic interference resulted from the transmission of high energy pulses by the first cable 270.

As shown in FIG. 4A, the apparatus 250 includes a cage 400, a shield 410 within the cage 400, and a connector 420 at the cage 400. The cage 400 has a cover 402 that may be opened to provide an access port. Alternatively, the cover 402 may not be opened, and may be permanently connected to the sides of the cage 400. The cage 400 is grounded and is mounted to a mounting flange 404 at the Magnetron 216 by mechanical connection in such a way that it, as well as any other mechanical interfaces, are sealed with respect to EMI.

The connector 420 (e.g., receptacle) is configured to detachably connect to the cable connector 274 (e.g., plug) at an end of the first cable 270. The connector 420 is attached to the cage 400, and provides a connection point for the cable connector 274 so that a 360° ground is provided when the connector 274 of the first cable 270 is plugged to the connector 420.

In some embodiments, the cage 400 may be perforated to allow air flow to achieve convection cooling, and to allow for ozone generated by the high voltage to dissipate. Perforations diameter may be less than 1/100 wavelength of the highest desired attenuation frequency in order to minimize or at least reduce RF leakage. In other embodiments, the perforations diameter may have other values, and may be more than 1/100 wavelength of the highest desired attenuation frequency.

As shown in the figure, the shield 410 is in a form of a container, and at least a majority of the shield 410 is spaced away from an interior wall of the cage 400. As shown in the figure, a portion (e.g., the top portion) of the shield 410 has a dome shape. In other embodiments, the shield 410 may have other shapes. Also, in some embodiments, the shield 410 is sized and shaped to prevent arching condition from developing during use of the apparatus 250. In addition, in some embodiments, the shield 410 may have a first shield portion and a second shield portion that is detachably coupled to the first shield portion. The second shield portion may be opened to allow inspection and/or servicing of the components inside the shield 410. In some cases, the second shield portion may be the top portion (lid) of the shield 410.

As shown in FIG. 4B, the shield 410 has a first opening 412 for receiving wires from the connector 420. The first opening 412 is at a side of the shield 410. In other embodiments, the first opening 412 may be at other locations on the shield 410. The shield 410 also has a second opening 414*a* and a third opening 414*b* for receiving respectively two terminals (stems, filaments, or feed-through) at the Magnetron 216. In particular, the Magnetron 216 has a cathode terminal and a heater terminal (shown as items 500, 502 in FIG. 5). Two threaded rods are each installed into the cathode terminal and the heater terminal of the Magnetron 216 and enter into the cavity of the shield 410 through the respective openings 414*a*, 414*b*. The cathode terminal is electrically connected to the shield 410 (e.g., by a bolt and washer), and the heater terminal is electrically isolated from the shield 410 by an insulating bushing (e.g., a plastic material).

As shown in FIGS. 4A and 4B, the apparatus 250 further include a RF absorber 430 located inside the cage 400. The RF absorber 430 is configured to attenuate electromagnetic radiation that is launched from the high voltage feed-through. This feature helps to minimize or at least reduce a de-stabilizing effect of reflected and subsequently reabsorbed or recoupled radiation resulted from the operation of the Magnetron 216.

The apparatus 250 also includes a protection circuit 450 inside the shield 410. The protection circuit 450 is configured to protect the Magnetron terminals (e.g., filaments) from excessive voltage during normal pulsing and during arc conditions. In particular, the protection circuit 450 is configured to prevent current from flowing through the protection circuit 450 until a pre-determined voltage is reached. In one implementation, the protection circuit 450 includes a voltage limiting device (such as a transient-voltage-suppression diode, spark gap, Zener diode, varistor, etc.), and a capacitor both connected in parallel to the Magnetron's terminals. Also, in other embodiments, the protection circuit 450 may include a bipolar or unipolar transient-voltage suppression (TSV) diode. In some embodiments, the protection circuit 450 is provided a threshold voltage, wherein when the voltage at the protection circuit 450 reaches such threshold voltage, the protection circuit 450 will start conducting. The threshold voltage may be selected to be at a level that is above the heater voltage, but below a level that may result in damage to the system, particularly the damage threshold voltage of the capacitor. In some cases, the threshold voltage of the TVS diode may be selected to be as close to the damage threshold of the system as tolerances will allow, in order to prevent the TVS diode from conducting too often on small amplitude voltage transients and being damaged form heating. The capacitance of the capacitor may be selected to be as high as practical to maximize reduction of voltage transients. The voltage rating of the capacitor may be selected to be sufficiently high that a TVS diode will not conduct on small spikes (which would not damage other parts of the system). The type of capacitor may be chosen to provide low inductance and high energy density. In one implementation the heater voltage is 6.7 volts and the damage threshold voltage of the capacitor is above 100 volts. Also, the capacitor may be made from a ceramic dielectric and has a capacitance of 100 microfarads.

Figure 5:
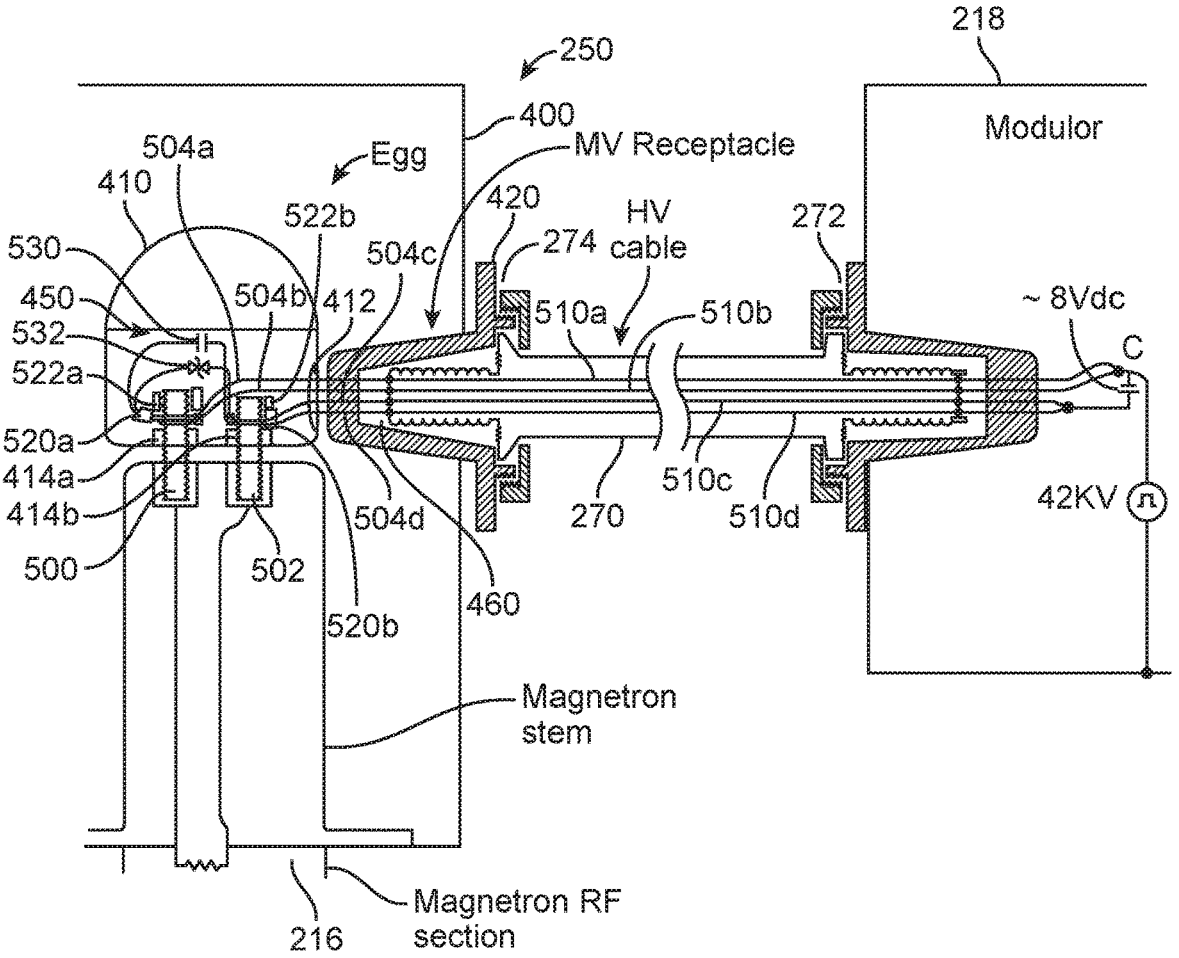
FIG. 5 illustrates additional details for the first apparatus of FIG. 4A.

FIG. 5 illustrates additional details for the first apparatus 250 of FIG. 4A, particularly showing how the wires in the first cable 270 are connected between the modulator 218 and the first apparatus 250, and how the terminals 500, 502 from the Magnetron 216 are connected to wires inside the shield 410. As shown in the figure, the Magnetron 216 has a cathode terminal 500 and a heater terminal 502. The cathode terminal 500 goes through the opening 414*a* at the bottom of the shield 410, and the heater terminal 502 goes through the opening 414*b* at the bottom of the shield 410.

As shown in the figure, the connector 420 at the first apparatus 250 has four wires 504*a*-504*d* that go through a channel 460 (extending between the wall of the cage 400 and the shield 410), and enter into a cavity of the shield 410 through the first opening 412 at the side of the shield 410. The wires 504*a*-504*d* may be extensions of the wires 510*a*-510*d* from the cable 270, or they may be separate wires that are connected to the wires 510*a*-510*d* from the cable 270. Two (i.e., 504*a*, 504*b*) of the four wires connect to the cathode terminal 500 of the Magnetron 216, and another two (i.e., 504*c*, 504*d*) of the four wires connect to the heater terminal 502 of the Magnetron 216. Also, in some embodiments, the terminals 500, 502 of the Magnetron 216 may be rods (e.g., threaded rods). These rods may protrude up into the cavity of the shield 410 through the openings 414*a*, 414*b* at the bottom of the shield 410. The rods of the Magnetron 216 may be mechanically connected to the shield 410 to support the shield 410, but only the cathode terminal 500 is connected electrically to the shield 410. The rod that is the heater terminal 502 may be electrically isolated form the shield 410 by an insulator bushing or other type of insulator. In the implementation shown, the wires 504*a*-504*d* from the connector 420 have respective ring terminals 520 on their respective ends, and these ring terminals 520 are attached to the threaded rod (terminals 500, 502 of the Magnetron 216) by nuts 522*a*, 522*b*.

In other embodiments, the openings 414*a*, 414*b* may be at other locations of the shield 410. Also, in other embodiments, the number of openings 414 may be different from two. For example, there may be only one opening for allowing both terminals 500, 502 to extend therethrough into the cavity of the shield 410. In addition, in other embodiments, the number of openings at the shield 410 for receiving the wires 504 from the connector 420 and for receiving the terminals 500, 502 of the Magnetron 216 may be different from the examples described. For example, in other embodiments, the shield 410 may have only a single opening for receiving the wires 504 from the connector 420, as well as the terminals 500, 502 of the Magnetron 216.

As shown in FIG. 5, the protection circuit 450 comprises a capacitor 530 and a voltage limiting device 532. The capacitor 530 has a first lead and a second lead, the voltage limiting device 532 has a third lead and a fourth lead. The first lead of the capacitor 530 and the third lead of the voltage limiting device 532 are connected to the cathode electrode 500 that is extended into the shield 410. The second lead of the capacitor 530 and the fourth lead of the voltage limiting device 532 are connected to the heater terminal 502 that is extended into the shield 410.

In other embodiments, the capacitor 530 and voltage limiting device 532 may be soldered onto a circuit board, and the circuit board may be attached to the terminals 500, 502 of the Magnetron 216. However, traces on the circuit board may increase the resistance to the voltage limiting device 532 and the capacitor 530, and may prevent them from performing their functions properly. Thus, it may be desirable to directly connect the capacitor 530 and voltage limiting device 532 to the terminals 500, 502 of the Magnetron 216, e.g., via ring lugs as described earlier.

Also, in some embodiments, the protection circuit 450 is placed as close to the terminals 500, 502 of the Magnetron 216 as possible, but not inside the Magnetron 216. In other embodiments, the protection circuit 450 may be placed at other locations, such as inside the modulator.

In some embodiments, the cable 270 has a length selected to provide a desired capacitance matching (between that of the modulator 218 and that of the Magnetron 216), and to tune the RF waveform shape or pulse shape of the Magnetron 216. Such feature may eliminate the need for utilizing matching capacitors within the cage 400. Elimination of the capacitors within the cage 400 may also have the benefit of reducing the number of parts need to be fastened, associated costs, and reliability risk. Furthermore, elimination of the capacitors within the cage 400 may reduce the size of the cage 400, reduce corona discharge, reduce ozone generation, and reduce the risk of dielectric break down. In other embodiments, instead of using a cable length for capacitance matching, capacitors may be provided to perform such function. The capacitors may be placed inside the cage 400 or inside the modulator.

During use, the Magnetron 216 uses interaction of a stream of electrons, guided by a magnetic field provided by the magnet(s) 440 (which may be permanent magnet(s) or electromagnet(s)), to produce electromagnetic waves (e.g., microwave radiation). The cathode is heated by current passing through it, causing it to produce electrons. The electrons are accelerated away from the cathode by a negative high voltage pulse which gives them kinetic energy. The electrons are deflected by magnetic field from the permanent magnet into circular paths. The electrons pass by RF resonant cavities within the magnetron, and transfer some of their kinetic energy to electric and magnetic fields within these cavities. The electric and magnetic fields in the cavities are coupled to the rest of the RF system through the magnetron's output waveguide port. The microwaves may then be directed to the accelerator 212. The cage 400 is configured to maintain a desired high voltage clearance from the Magnetron high voltage feed-through at a certain voltage (e.g., at 45 kV or other levels) to grounded surface, and utilizes the shield 410 in the cage 400, so that shield discharge is minimized or at least reduced within the cage 400. In some cases, during operation, a voltage between the two terminals 500, 502 has a first voltage value, and a voltage between the shield 410 and the cage 400 has a second voltage value that is higher than the first voltage. For example, the second voltage may be at least 1000 times larger than the first voltage.

In the illustrated embodiments, the shield 410 is a conductor around the terminals 500, 502 from the Magnetron 216. The voltage inside the shield 410 is relatively small. For example, the voltage between the terminals 500, 502 inside the shield 410 may be anywhere from 2 V to 20 V (e.g., 6 V). Outside the shield 410, high voltage gradients exist, but field lines are relatively smooth with no sharp edges. In some cases, the size (e.g., cross sectional dimension) of the shield 410 is designed so that the high voltage gradients not too large (e.g., above a certain threshold criteria).

The apparatus 250 is advantageous because it provides EMI containment at the interface between the Magnetron 216 and the cable 270. The apparatus 250 is easy to manufacture and is easy to install. The apparatus 250 also obviates the need to build complex sheet metal enclosure, which is expensive to build, and is labor intensive (because it may require use of many fasteners to assemble). Complex sheet metal enclosure is also complicated to assemble, and makes servicing of the components difficult. In addition, EMI cage created using complex sheet metals may require conductive tape to seal the seams at the EMI cage. On the other hand, the apparatus 250 obviates the need to use conductive tape.

It should be noted that the apparatus 250 is not limited to being used with the Magnetron 216, and that the apparatus 250 may be used with other electromagnetic wave generator. Thus, in other embodiments, the apparatus 250 may be implemented at an interface between any cable and any electromagnetic wave generator.

Figure 6:
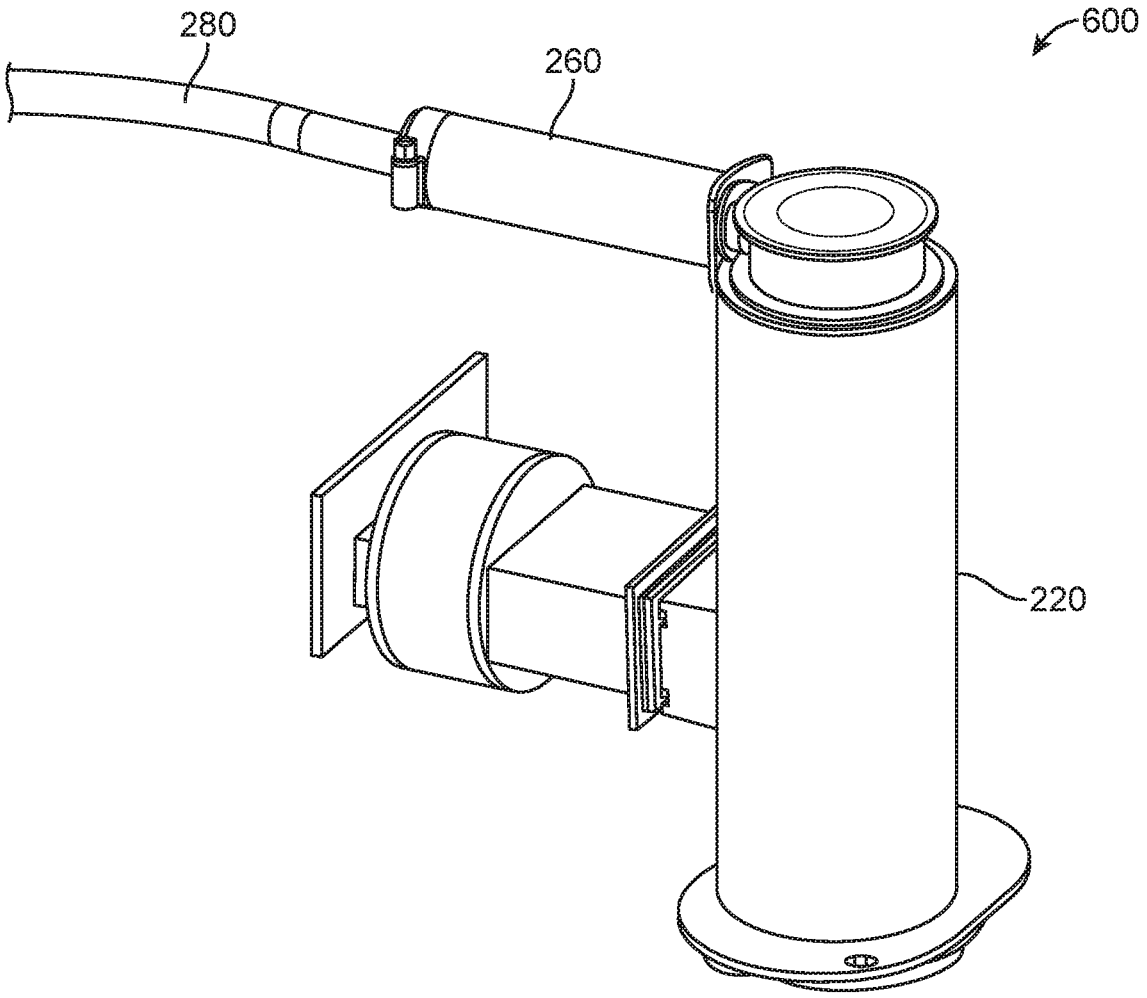
FIG. 6 illustrates the second apparatus of FIG. 2.
Figure 7:
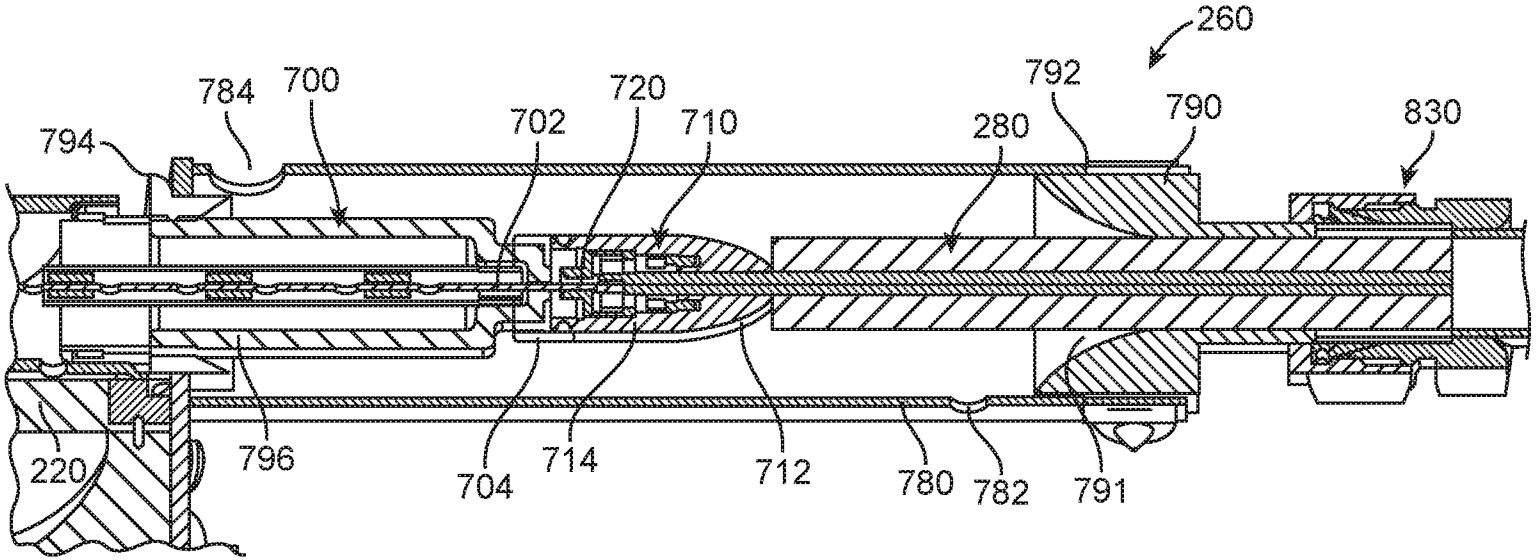
FIG. 7 illustrates the second apparatus of FIG. 2, particularly showing the second apparatus connecting a cable to an electron gun.

FIG. 6 illustrates a cable-to-electron gun interface 600 that includes the second apparatus 260 for providing EMI containment around the feed-through of an electron gun 220. FIG. 7 illustrates the apparatus 260, particularly showing details of the apparatus 260. The apparatus 260 is for coupling to an input connection (feed-through) 700 of the electron gun 220. As shown in the figure, the input connection 700 has a heater terminal 702 and a cathode terminal 704. The apparatus 260 includes a connector 710 having a first end 712 and a second end 714. The first end 712 of the connector 710 is configured to attach to the cable 280. The second end 714 of the connector 710 is configured to connect to the input connection 700 of the electron gun 220. The connector 710 comprises an opening 720 configured to receive the heater terminal 702 of the input connection 700 of the electron gun 220. The connector 710 may be made from brass, copper, stainless steel, etc., or any combination of the foregoing.

In the illustrated embodiments, the connector 710 has a bullet shape. In particular, the connector 710 has an outer curvilinear surface that reduces in cross sectional dimension as a function of a longitudinal length of the apparatus 260. This configuration is advantageous because it prevents or reduces the chance of formation of high field region. In other embodiments, the connector 710 may have other shapes. Also, in the illustrated embodiments, the first end 712 of the connector 710 has a cross sectional dimension that varies non-linearly. In other embodiments, the first end 712 of the connector 710 may not vary non-linearly, and may instead vary linearly, may be constant, or may have other profiles. In some cases, the connector 710 may have a profile with an arc, wherein the radius of the arc is selected to minimize or at least reduce an electric field inside a potting material.

Figure 8:
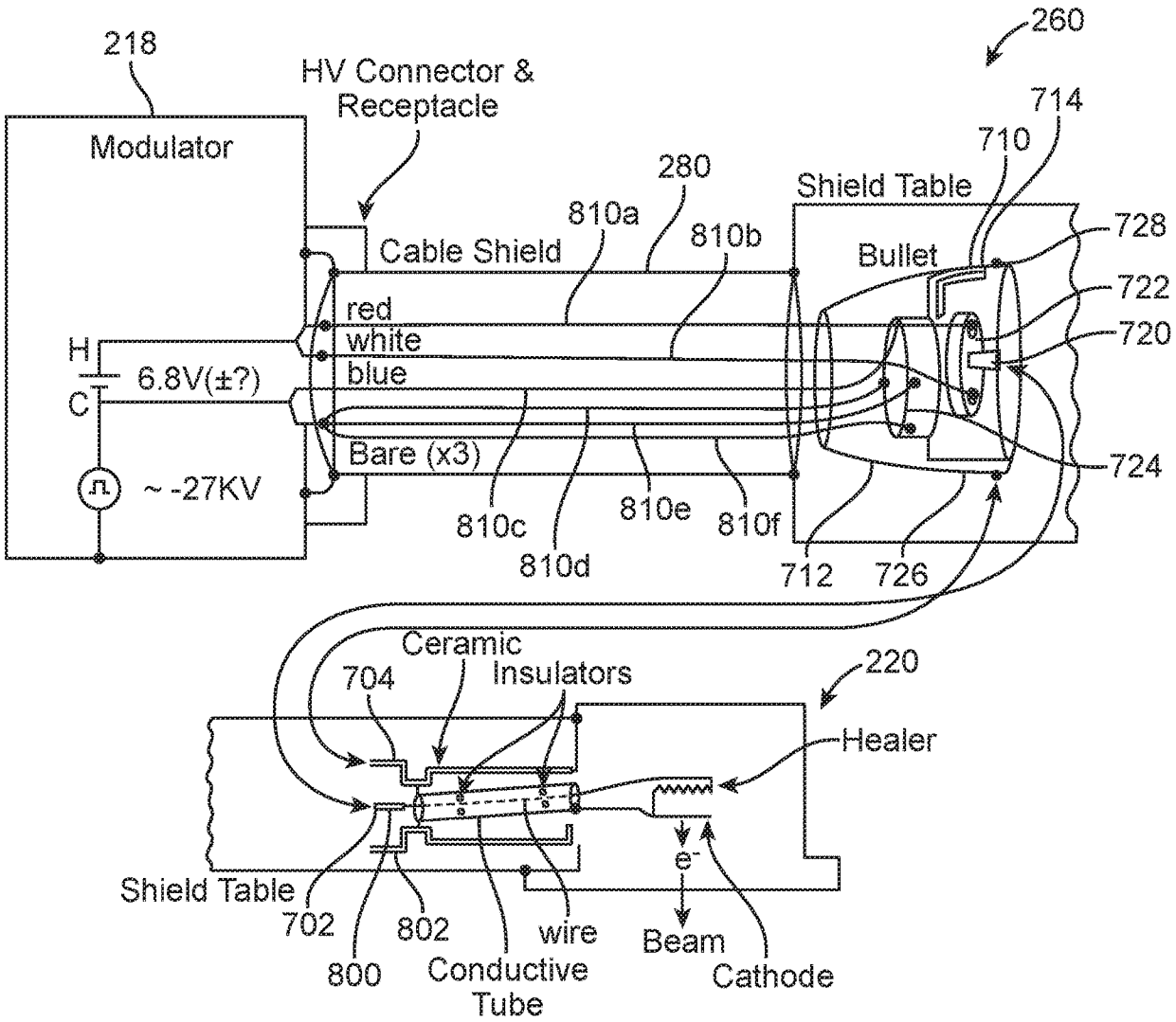
FIG. 8 illustrates additional details for the second apparatus of FIG. 7.

FIG. 8 illustrates additional details of the apparatus 260 of FIG. 7. As shown in the figure, the heater terminal 702 of the electron gun 220 comprises a pin 800. The cathode terminal 704 of the electron gun comprises a cylindrical connector 802. The second end 714 of the connector 710 has an outer cross sectional dimension sized to fit within the cylindrical connector 802 of the electron gun 220.

In the illustrated embodiments, the second end 714 of the connector 710 includes a coil 728 (e.g., a canted coil), and the coil 728 is configured to circumferentially engage the cylindrical connector 802 of the electron gun 220 when the cylindrical connector 802 is placed over the coil 728.

As shown in FIGS. 7 and 8, the connector 710 comprises a first section 722 (female connector) with the opening 720, wherein the first section 722 is configured for connection with a first wire 810*a* from the cable 280. The female connector 722 is electrically isolated and coaxial in the center of the connector 710. The connector 710 also comprises a second section 724 configured for connection with a second wire 810*c* from the cable 280. The second section 724 is electrically coupled to, or comprises, a circular structure (e.g., metal cylinder) 726 circumferentially disposed around the first section 722. The first wire 810*a* from the cable 280 is electrically connected to a heater terminal at the modulator 218, and the second wire 810*c* from the cable 280 is electrically connected to a cathode terminal at the modulator 218.

As shown in FIG. 8, the cable 280 includes additional wires 810*b*, 810*d*-810*f*. The wire 810*b* is connected to the heater terminal at the modulator 260 at one end, and is connected to the first section 722 at the connector 710. The wires 810*d*-810*f* are connected to the cathode terminal at the modulator 260 at one end, and are connected to the second section 724 at the connector 710. Thus, wires 810*a*, 810*b* function as heater wires from the cable 280, and wires 810*c*-810*f* function as cathode wires from the cable 280. Having additional wire(s) connected between the modulator 218 and the connector 710 is advantageous because such configuration reduces the high frequency impedance of the wires cause by skin effects and creates smoother electric field profiles within the cable. In other embodiments, the wires 810*b*, 810*d*-810*f* are optional, and the cable 280 may not include these wires. The wires 810*a*, 810*b* in the cable 280 for the heater connection are connected to the center female connector 722 (which in turn, is configured to receive the pin 800 of the electron gun 220). The wires 810*c*-810*f* in the cable 280 that are to be connected to the cathode are connected to the metal cylinder 726 at the connector 710.

As shown in FIGS. 7 and 8, the apparatus 260 further includes a tube 780 disposed around the input connection 700 of the electron gun 220. Optionally, the tube 780 may be slidable relative to the input connection 700 of the electron gun 220 and also relative to the connector 710 of the apparatus 260. As shown in the figure, the tube 780 has a wall with a first opening 782 and a second opening 784. The first opening 782 and the second opening 784 are at respective opposite sides of the tube 780. In other embodiments, the openings 782, 784 may be at other locations of the tube 780. In some cases, the openings 782, 784 are disposed at locations where low field regions are expected to exist during operation of the apparatus 260.

During installation of the apparatus 260, potting material may be inserted into the opening 782 to fill the space defined by the interior wall of the tube 780. As the potting material is being inserted into the opening 782, air may be pushed out of the opening 784. After the potting material has been inserted, the tube 780 is configured to contain the potting material. The potting material has relatively high dielectric breakdown threshold (also known as high dielectric strength), and is configured to prevent or at least reduce arching between the connector 710 and the surrounding tube 780. The potting material may also prevent corona from occurring. The filling of the tube with potting material should be done in such a way as to reduce bubbles in the potting material (which may cause dielectric breakdown of the insulation potting material).

The apparatus 260 further includes a first seal structure 790 disposed at one end 792 of the tube 780. The first seal structure 790 has an opening 791 for receiving the cable 280. The first seal structure 790 has a curvilinear inner surface, and a distance between the curvilinear inner surface and the cable 280 varies non-linearly as a function of a position along a longitudinal axis of the cable 280. This configuration is advantageous because it prevents or reduces the chance of formation of high field region. As shown in the figure, the first seal structure 790 has a funnel shape. In other embodiments, the first seal structure 790 may have other configurations. For example, in other embodiments, the first seal structure 790 may not have a curvilinear inner surface, and may have a linear surface instead. Also, in other embodiments, a distance between the inner surface of the first seal structure 790 and the cable 280 may vary linearly as a function of a position along the longitudinal axis of the cable 280, or may be constant. In some cases, the curved surface of the seal structure 790 prevents or at least reduces high field region and electric fields in the potting material from developing.

The apparatus 260 also includes a second seal structure 794 disposed at the opposite end 796 of the tube 780.

The cable 280 is shield at its exterior. The cable 280 is electrically grounded to the modulator 218 at one end of the cable 280, and is electrically grounded to the tube 780 at the other end of the cable 280. The cable 280 at the electron gun connection end is shielded circumferentially (360°), providing containment of EMI.

Also, as shown in FIG. 7, the cable 280 is coupled to the first seal structure 790 via a strain relief connector 830. In some embodiments, the connector 830 has a conical portion that compresses a copper tube, sandwiching a braid layer of the cable 280 between the copper tube and a stainless steel tube underneath. This configuration creates a low resistance electrical connection. Further tightening of the fitting will cause the stainless tube to deform, compressing a rubber insulation of the cable 280, and providing a mechanical connection for strain relief.

In some embodiments, a protection circuit (identical or similar to the protection circuit 450) may be provided for the gun heater. The protection circuit may be installed inside the modulator, or may be installed at other locations. Regardless of where the protection circuit is implemented, it may be considered as being coupled to the apparatus 260 or may be considered as a component of the apparatus 260.

During installation of the apparatus 260, the connector 710 with the cable 280 attached thereto is initially manually connected to the heater and cathode terminals 702, 704 of the electron gun 220. In one technique, the connector 710 is pushed towards the input connection 700 of the electron gun 220 so that pin 800 of the electron gun 220 is inside the opening 720 of the connector 710, and the cylindrical connector 802 of the electron gun 220 is circumferentially surrounding the coil 728 at the end 714 of the connector 710. In the illustrated embodiments, after the connector 710 is connected to the input connection 700 of the electron gun 220, the end 714 of the connector 710 is flushed with the cylindrical connector 802 at the electron gun 220. This feature prevents or at least reduces high field region and electric fields in the potting material from developing.

After the connector 710 is attached to the heater and cathode terminals of the electron gun 220, the tube 780 is then translated along its longitudinal axis to cover the connection made. When the tube 780 has been desirably positioned, the strain relief connector 830 may then be operated to secure the cable 280 relative to the seal structure 790 and to the tube 780. Next, potting material may then be inserted into the cavity in the tube 780 through opening 784 to fill the cavity in the tube 780.

In the illustrated embodiments, the electron gun's feed-through is physically connected and potted directly to the shielded high voltage cable 280, thereby eliminating bulk, length, and cost of existing connector. The connection may be accomplished using hard-wiring, or using detachable couplers. Also, the above apparatus 260 is advantageous because it allows the above installation technique to be easy to carry out without requiring significant training on the installer. The above apparatus 260 and installation technique are advantageous because they allow reliable connections to be made while reducing risk of installation errors. In addition, the apparatus 260 is also advantageous because it provides a compact connection with the electron gun 220, thereby eliminating the need to use long and bulky electron gun connector (which creates unnecessary risk of failure because long and bulky electron gun connector may get hit easier). Furthermore, in the above embodiments, after the potting material has been inserted and has set, the connector 710 cannot be unplugged from the electron gun 220 (at least not without breaking the potting material). This provides added securement and added reliability to the connection.

In the above embodiments, a single modulator 218 is configured to provide pulses to the Magnetron 216 and the electron gun 220. In other embodiments, separate modulators may be configured to provide pulses to the Magnetron 216 and the electron gun 220, respectively.

Also, in other embodiments, EMI shielding enclosure may be integrated into one or more covers. For example, one or more mechanical covers covering the permanent magnet of the Magnetron 216, the Magnetron 216, the electron gun 220, the modulator 218, other components of a radiation system, or any combination of the foregoing, may be used to implement EMI shielding or at least a part of a EMI shielding.

Furthermore, in other embodiments, the Magnetron 216 and/or the electron gun 220 may be placed inside the modulator 218 or inside an extension of the modulator 218, so that all EMI sources are contained in one enclosure. This configuration will eliminate the need for shielded cables and connectors.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. An apparatus for coupling to an input connection of an electron gun, the input connection having a heater terminal and a cathode terminal, the apparatus comprising:

a connector having a first end and a second end;

wherein the first end of the connector is configured to attach to a cable;

wherein the second end of the connector is configured to connect to the input connection of the electron gun;

wherein the connector comprises an opening configured to receive the heater terminal of the input connection of the electron gun;

wherein the apparatus further comprises a tube, and a seal structure disposed at one end of the tube, the seal structure having an opening for receiving the cable, wherein the seal structure has a curvilinear inner surface, and wherein a distance between the curvilinear inner surface and the cable varies non-linearly as a function of a position along a longitudinal axis of the cable.

2. The apparatus of claim 1, wherein the connector has a bullet shape.

3. The apparatus of claim 1, wherein the first end of the connector has a cross sectional dimension that varies non-linearly.

4. The apparatus of claim 1, wherein the heater terminal comprises a pin.

5. The apparatus of claim 1, wherein the cathode terminal of the electron gun comprises a cylindrical connector, and wherein the second end of the connector has an outer cross sectional dimension sized to fit within the cylindrical connector of the electron gun.

6. The apparatus of claim 5, wherein the second end of the connector comprises a coil, and wherein the coil is configured to circumferentially engage the cylindrical connector of the electron gun.

7. The apparatus of claim 1, wherein the connector comprises a first section with the opening, wherein the first section is configured for connection with a first wire from the cable.

8. The apparatus of claim 7, wherein the connector comprises a second section configured for connection with a second wire from the cable, wherein the second section is electrically coupled to a circular structure circumferentially disposed around the first section.

9. The apparatus of claim 1, wherein the connector comprises a first section with first plurality of connection terminals for connection with respective cathode wires from the cable.

10. The apparatus of claim 9, wherein the connector comprises a second section with a second plurality of connection terminals for connection with respective heater wires from the cable.

11. The apparatus of claim 9, wherein the first section comprises the opening.

12. The apparatus of claim 10, wherein the second section is electrically coupled to a circular structure circumferentially disposed around the first section.

13. The apparatus of claim 1, wherein the tube is disposed around a component of the electron gun.

14. The apparatus of claim 13, wherein the tube is slidable relative to the component of the electron gun.

15. The apparatus of claim 13, wherein the tube has a wall with a first opening and a second opening.

16. The apparatus of claim 15, wherein the first opening and the second opening are at respective opposite sides of the tube.

17. The apparatus of claim 13, wherein the tube is configured to contain potting material.

* * * * *